US007492348B2

(12) United States Patent
Matsuda

(10) Patent No.: US 7,492,348 B2
(45) Date of Patent: Feb. 17, 2009

(54) ELECTROPHORIC DISPLAY APPARATUS WITH GRADATION SIGNAL CONTROL

(75) Inventor: Yojiro Matsuda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 160 days.

(21) Appl. No.: 10/552,978

(22) PCT Filed: Jul. 8, 2004

(86) PCT No.: PCT/JP2004/010081

§ 371 (c)(1),
(2), (4) Date: Jul. 31, 2006

(87) PCT Pub. No.: WO2005/006299

PCT Pub. Date: Jan. 20, 2005

(65) Prior Publication Data

US 2006/0262080 A1 Nov. 23, 2006

(30) Foreign Application Priority Data

Jul. 9, 2003 (JP) ..... 2003-194589

(51) Int. Cl.
*G09G 3/34* (2006.01)

(52) U.S. Cl. ..... 345/107

(58) Field of Classification Search ..... 345/87, 345/58, 92, 94, 101, 100, 107
See application file for complete search history.

(56) References Cited

U.S. PATENT DOCUMENTS

| | | | | |
|---|---|---|---|---|
| 5,841,411 | A * | 11/1998 | Francis | 345/58 |
| 6,822,783 | B2 | 11/2004 | Matsuda et al. | 359/296 |
| 6,987,502 | B1 | 1/2006 | Kishi et al. | 345/107 |
| 7,009,756 | B2 | 3/2006 | Kishi et al. | 359/296 |
| 2001/0043180 | A1 * | 11/2001 | Mori et al. | 345/87 |
| 2005/0190431 | A1 | 9/2005 | Matsuda | 359/296 |

FOREIGN PATENT DOCUMENTS

| | | |
|---|---|---|
| EP | 0 700 028 | 3/1996 |
| JP | 2000-258805 | 9/2000 |

* cited by examiner

*Primary Examiner*—David L Lewis
(74) *Attorney, Agent, or Firm*—Fitzpatrick, Cella, Harper & Scinto

(57) ABSTRACT

A display apparatus includes an electrophoretic display device having a plurality of pixels arranged in a matrix, each pixel including charged particles in a dispersion liquid and a pair of electrodes disposed close to the dispersion liquid, and a position of the charged particles in the pixel providing a gradation, and a drive circuit for outputting a gradation signal to each pixel. The gradation of each pixel is influenced by gradation signals of adjacent pixels through an electric field interference between pixels. In addition, a correction circuit corrects the gradation signal at each pixel to compensate for the influence from the gradation signals of the adjacent pixels.

4 Claims, 13 Drawing Sheets

| | GRADATION SIGNAL | REFLECTANCE OF PIXEL A |
|---|---|---|
| GRADATION 1 | $V_1$ = -10V | 5% |
| GRADATION 2 | $V_2$ = 0.7V | 9% |
| GRADATION 3 | $V_3$ = 1.3V | 13% |
| GRADATION 4 | $V_4$ = 2V | 17% |
| ⋮ | ⋮ | ⋮ |
| GRADATION 14 | $V_{14}$ = 8.7V | 57% |
| GRADATION 15 | $V_{15}$ = 9.4V | 61% |
| GRADATION 16 | $V_{16}$ = 10V | 65% |

FIG. 2

| | A B C D E | GRADATION SIGNAL OF PIXEL A | REFLECTANCE OF PIXEL A |
|---|---|---|---|
| GRADATION 1 | 1 1 1 1 1 | V1 | 5% |
| GRADATION 2 | 2 2 2 2 2 | V2 | 9% |
| GRADATION 3 | 3 3 3 3 3 | V3 | 13% |
| GRADATION 4 | 4 4 4 4 4 | V4 | 17% |
| | ⋮ | | ⋮ |
| GRADATION 14 | 14 14 14 14 14 | V14 | 57% |
| GRADATION 15 | 15 15 15 15 15 | V15 | 61% |
| GRADATION 16 | 16 16 16 16 16 | V16 | 65% |

FIG.3

(a) GRADATION 4 AT PIXEL A

| | A | B | C | D | E | REFLECTANCE | GRADATION SIGNAL |
|---|---|---|---|---|---|---|---|
| K11 | 4 | 1 | 1 | 1 | 1 | 17% | V4 |
| | 4 | 1 | 1 | 1 | 2 | 17% | V4 |
| | 4 | 1 | 1 | 2 | 2 | 17% | V4 |
| | 4 | 1 | 2 | 2 | 2 | 17% | V4 |
| | 4 | 2 | 2 | 2 | 2 | 17% | V4 |
| | | | ⋮ | | | ⋮ | ⋮ |
| | 4 | 7 | 7 | 7 | 7 | 17% | V4 |
| | 4 | 7 | 7 | 7 | 8 | 17% | V4 |
| | 4 | 7 | 7 | 8 | 8 | 16.9% | V4 |
| | 4 | 7 | 8 | 8 | 8 | 16.9% | V4 |
| | 4 | 8 | 8 | 8 | 8 | 16.8% | V4 |
| | | | ⋮ | | | ⋮ | ⋮ |
| K12 | 4 | 15 | 15 | 15 | 15 | 15.2% | V4' |
| | 4 | 15 | 15 | 15 | 16 | 15.2% | V4' |
| | 4 | 15 | 15 | 16 | 16 | 15.1% | V4' |
| | 4 | 15 | 16 | 16 | 16 | 15% | V4' |
| | 4 | 16 | 16 | 16 | 16 | 15% | V4' |

(b) GRADATION 8 AT PIXEL A

| | A | B | C | D | E | REFLECTANCE | GRADATION SIGNAL |
|---|---|---|---|---|---|---|---|
| K21 | 8 | 1 | 1 | 1 | 1 | 34.2% | V8' |
| | 8 | 1 | 1 | 1 | 2 | 34.1% | V8' |
| | 8 | 1 | 1 | 2 | 2 | 34.0% | V8' |
| | 8 | 1 | 2 | 2 | 2 | 34.0% | V8' |
| | 8 | 2 | 2 | 2 | 2 | 33.8% | V8' |
| | | | ⋮ | | | ⋮ | ⋮ |
| K22 | 8 | 7 | 7 | 7 | 7 | 33% | V8 |
| | 8 | 7 | 7 | 7 | 8 | 33% | V8 |
| | 8 | 7 | 7 | 8 | 8 | 33% | V8 |
| | 8 | 7 | 8 | 8 | 8 | 33% | V8 |
| | 8 | 8 | 8 | 8 | 8 | 33% | V8 |
| | | | ⋮ | | | ⋮ | ⋮ |
| K23 | 8 | 15 | 15 | 15 | 15 | 31.4% | V8" |
| | 8 | 15 | 15 | 15 | 16 | 31.5% | V8" |
| | 8 | 15 | 15 | 16 | 16 | 31.5% | V8" |
| | 8 | 15 | 16 | 16 | 16 | 31.6% | V8" |
| | 8 | 16 | 16 | 16 | 16 | 31.6% | V8" |

FIG.4

(a) GRADATION 12 AT PIXEL A

| | A | B | C | D | E | REFLECTANCE | GRADATION SIGNAL |
|---|---|---|---|---|---|---|---|
| K31 | 12 | 1 | 1 | 1 | 1 | 50.6% | $V_{12}'$ |
| | 12 | 1 | 1 | 1 | 2 | 50.5% | $V_{12}'$ |
| | 12 | 1 | 1 | 2 | 2 | 50.5% | $V_{12}'$ |
| | 12 | 1 | 2 | 2 | 2 | 50.4% | $V_{12}'$ |
| | 12 | 2 | 2 | 2 | 2 | 50.4% | $V_{12}'$ |
| | | | ⋮ | | | ⋮ | ⋮ |
| K32 | 12 | 7 | 7 | 7 | 7 | 49% | $V_{12}$ |
| | 12 | 7 | 7 | 7 | 8 | 49% | $V_{12}$ |
| | 12 | 7 | 7 | 8 | 8 | 49% | $V_{12}$ |
| | 12 | 7 | 8 | 8 | 8 | 49% | $V_{12}$ |
| | 12 | 8 | 8 | 8 | 8 | 49% | $V_{12}$ |
| | | | ⋮ | | | ⋮ | ⋮ |
| | 12 | 15 | 15 | 15 | 15 | 48.9% | $V_{12}$ |
| | 12 | 15 | 15 | 15 | 16 | 48.8% | $V_{12}$ |
| | 12 | 15 | 15 | 16 | 16 | 48.8% | $V_{12}$ |
| | 12 | 15 | 16 | 16 | 16 | 48.8% | $V_{12}$ |
| | 12 | 16 | 16 | 16 | 16 | 48.7% | $V_{12}$ |

(b) GRADATION 16 AT PIXEL A

| | A | B | C | D | E | REFLECTANCE | GRADATION SIGNAL |
|---|---|---|---|---|---|---|---|
| K41 | 16 | 1 | 1 | 1 | 1 | 67.0% | $V_{16}'$ |
| | 16 | 1 | 1 | 1 | 2 | 67.0% | $V_{16}'$ |
| | 16 | 1 | 1 | 2 | 2 | 67.0% | $V_{16}'$ |
| | 16 | 1 | 2 | 2 | 2 | 66.8% | $V_{16}'$ |
| | 16 | 2 | 2 | 2 | 2 | 66.8% | $V_{16}'$ |
| | | | ⋮ | | | ⋮ | ⋮ |
| K42 | 16 | 7 | 7 | 7 | 7 | 65.8% | V16 |
| | 16 | 7 | 7 | 7 | 8 | 65.7% | V16 |
| | 16 | 7 | 7 | 8 | 8 | 65.7% | V16 |
| | 16 | 7 | 8 | 8 | 8 | 65.6% | V16 |
| | 16 | 8 | 8 | 8 | 8 | 65.6% | V16 |
| | | | ⋮ | | | ⋮ | ⋮ |
| | 16 | 15 | 15 | 15 | 15 | 65% | V16 |
| | 16 | 15 | 15 | 15 | 16 | 65% | V16 |
| | 16 | 15 | 15 | 16 | 16 | 65% | V16 |
| | 16 | 15 | 16 | 16 | 16 | 65% | V16 |
| | 16 | 16 | 16 | 16 | 16 | 65% | V16 |

FIG.5

ELECTROPHORIC DISPLAY APPARATUS WITH GRADATION SIGNAL CONTROL

TECHNICAL FIELD

The present invention relates to a display apparatus which includes a plurality of pixels arranged in a matrix and effects gradation display at each pixel.

BACKGROUND

In recent years, as a display device for displaying various information, an electrophoretic display device for displaying information by controlling a position of electrophoretic particles (charged migration particles) or a liquid crystal display device for displaying information by applying a voltage to a liquid crystal has received attention.

These display devices are constituted by a matrix of pixels each at which gradation display can be effected.

FIGS. 12(*a*) and 12(*b*) are respectively a sectional view showing an example of a structure of a conventional electrophoretic display device described in Japanese Laid-Open Patent Application (JP-A) No. 2000-258805. This electrophoretic display device includes a pair of substrates 21*a* and 21*b* provided with electrodes 24*a* and 24*b*, respectively. In a spacing between the substrates 21*a* and 21*b*, a dispersion liquid 22 and electrophoretic particles 23 are disposed. The dispersion liquid 22 and the electrophoretic particles 23 have been colored different colors. As shown in FIG. 12(*a*), in the case where the electrophoretic particles 23 are attracted to the electrode 24*a* side, the color (e.g., black) of the dispersion liquid 22 is visually identified as the color of the pixels. On the other hand, as shown in FIG. 12(*b*), in the case where the electrophoretic particles 23 are attracted to the electrode 24*b* side, the color (e.g., white) of the electrophoretic particles 23 is visually identified as the color of the pixels. Further, in the case where the electrophoretic particles 23 are stopped in an intermediary portion between the substrates 21*a* and 21*b*, a halftone is displayed.

Although there arises no particular problem in the case where voltages at adjacent pixels (pixels A and B) are equal to each other as shown in FIGS. 12(*a*) and 12(*b*) or provides a small difference therebetween, in the case where the voltage difference between the adjacent pixels is larger as shown in FIG. 13, arrangement of the electrophoretic particles at a boundary portion C between the adjacent pixels are disordered by an electric field interference between the adjacent pixels. As a result, an original gradation cannot be provided to impair a display quality in some cases.

DISCLOSURE OF THE INVENTION

An object of the present invention is to provide a display apparatus which effectively suppresses a deterioration in display quality.

According to the present invention, there is provided a display apparatus, comprising:

a display device comprising a plurality of pixels arranged in a matrix, a drive circuit for outputting a gradation signal to each of the pixels, and a correction circuit for correcting the gradation signal at each pixel so that a desired gradation can be provided by compensating an influence from adjacent pixels.

This and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 2 is a view showing an example of a relationship between gradation level, a gradation signal, and a display gradation (reflectance), at a pixel.

FIG. 3 is a view showing an example of a relationship between a gradation level, a gradation signal, and a display gradation (reflectance), in the case where an identical gradation is provided at a correction pixel and adjacent pixels.

FIG. 4(*a*) is a view showing a relationship between a combination of display gradations at a correction pixel and adjacent pixels (left column), a display gradation (reflectance) at the correction pixel in the case where correction is not made (central column), and a gradation signal for displaying an appropriate gradation at the correction pixel (right column), in the case where the gradation level at the correction pixel is 4; and FIG. 4(*b*) is a view showing a relationship between a combination of display gradations at a correction pixel and adjacent pixels (left column), a display gradation at the correction pixel in the case where correction is not made (central column), and a gradation signal for displaying an appropriate gradation at the correction pixel (right column), in the case where the gradation level at the correction pixel is B.

FIG. 5(*a*) is a view showing a relationship between a combination of display gradations at a correction pixel and adjacent pixels (left column), a display gradation (reflectance) at the correction pixel in the case where correction is not made (central column), and a gradation signal for displaying an appropriate gradation at the correction pixel (right column), in the case where the gradation level at the correction pixel is 5; and FIG. 5(*b*) is a view showing a relationship between a combination of display gradations at a correction pixel and adjacent pixels (left column), a display gradation at the correction pixel in the case where correction is not made (central column), and a gradation signal for displaying an appropriate gradation at the correction pixel (right column), in the case where the gradation level at the correction pixel is 16.

BEST MODE FOR CARRYING OUT THE INVENTION

Hereinbelow, embodiments of the present invention will be described with reference to FIGS. 1 to 11.

(1) First, a general structure of a display apparatus will be described.

Figure 1:
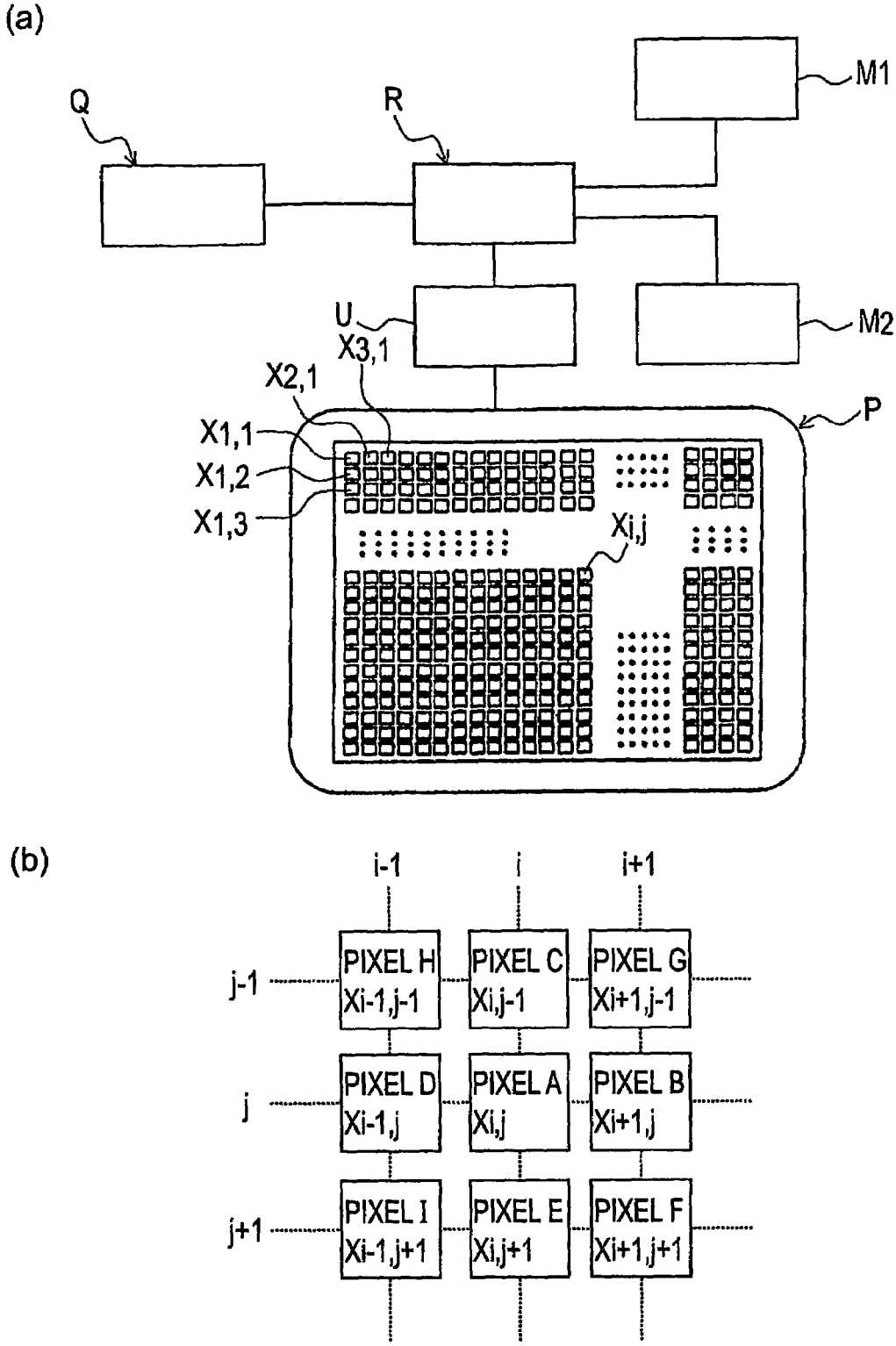
FIG. 1(*a*) is a block diagram showing a general structure of the display apparatus according to the present invention, and FIG. 1(*b*) is a schematic view showing an arrangement of pixels.

A display apparatus according to the present invention, as shown in FIGS. 1(*a*) and 1(*b*), includes a display device P having a plurality of pixels X1, 1, . . . arranged in a matrix, a drive circuit Q for outputting a gradation signal to each of the pixels X1, 1, . . . , and a correction circuit R correcting the gradation signal for each pixel so as to permit a desired gradation display by compensating an influence from adjacent pixels. In a preferred embodiment, the drive circuit Q outputs digital image data, and the correction circuit R corrects the digital image data depending on a characteristic of the display device P. Between the correction circuit R and the display device P, a circuit U which penetrates an analog signal for driving the display device P may preferably be disposed.

A display gradation may be controlled by: (a) a method wherein a magnitude of a voltage applied to each pixel is controlled in such a display device P that a display gradation is changed depending on a magnitude of the applied voltage (so-called "voltage modulation"); (b) a method wherein a period (length) of time of application of a voltage to each pixel is controlled in such a display device P that a display gradation is changed depending on a length of application time (so-called "pulse width modulation"; and (c) a method wherein both a magnitude of and a length of application of a voltage applied to each pixel are controlled in such a display device P that a display gradation is changed depending on both the magnitude of the applied voltage and the length of application of the applied voltage.

In the case of (a) and (c), the gradation signal comprises a signal for determining a magnitude of the applied voltage, and in the case of (b) and (c), the gradation signal comprises a signal for determining a length (period) of voltage application time.

(2) The correction circuit R will be described.

Assuming that only one pixel is virtually driven, as shown in FIG. 2, a gradation (level) 1 (GRADATION 1) is provided when the drive circuit Q applies a gradation signal V1. Similarly, a gradation 2 is displayed under application of a gradation signal V2, and a gradation x is displayed under application of a gradation signal Vx.

However, a relationship between the gradation signal Vx and the display gradation x at a pixel is not an absolute one, so that the display gradation x is changed under the influence of adjacent pixels surrounding the pixel when other pixels are also driven. (This will be described more specifically later.) In the case of FIG. 2, the gradation signal is a voltage signal. However, a similar problem arises in the case of the gradation signal comprising the signal for determining the length of voltage application time.

The correction circuit R is constituted so that it corrects a gradation signal applied to each pixel to compensate an influence from its adjacent pixels, thus providing a desired gradation at the pixel.

Herein, in case of necessity, a pixel at which a gradation signal is corrected by the above described correction circuit is referred to as a "correction pixel", and pixels disposed adjacent to the correction pixel are referred to as "adjacent pixels".

In the case where a pixel A (PIXEL A) shown in FIG. 1(*b*) is to be corrected, the influence on the pixel A from its adjacent pixels (e.g., pixels B, C, D and E) is compensated by the correction circuit R. Accordingly, in this case, the correction pixel is the pixel A and the adjacent pixels are the pixels B, C, D and E. Further, in the case where the pixel B is to be corrected, the influence on the pixel B from its adjacent pixels (e.g., pixels G, A, F, . . . ) is compensated by the correction circuit R. Accordingly, in this case the correction pixel is the pixel B, and the adjacent pixels are the pixels G, A, F, . . .

In the case where pixels are arranged in rows and columns as shown in FIG. 1(*b*), the number of pixels adjacent to the correction pixel A is 8, i.e., the pixels H, C, G, B, F, E, I and D, so that a gradation signal may be corrected with the assumption that all the eight pixels are the adjacent pixels but the correction of the gradation signal in the present invention is not particularly limited thereto. For example, the gradation signal may be corrected with the assumption that only four pixels B, C, D and E (upper, lower, left and right pixels) are the adjacent pixels or with the assumption that only two pixels D and B (left and right pixels) are the adjacent pixels. In the case where there is a pixel which is largely affected by electric field interference between adjacent pixels, correction to the gradation signal may preferably be made in view of the pixel.

In order to effect such a correction by the correction circuit R, the correction circuit R is required to obtain a gradation signal to be applied to a correction pixel on the basis of input of information on a gradation to be displayed at the correction pixel (e.g., pixel A) and input of information on a gradation to be provided at adjacent pixels (e.g., pixels B, C, D and E).

The correction of the gradation signal on the basis of inputted information may be made by the following methods.

A relationship between states of adjacent pixels (e.g., gradations (gradation levels) to be provided at adjacent pixels B, C, D and E, as shown in the left column of FIGS. 4(*a*), 4(*b*), 5(*a*) and 5(*b*)), a gradation (gradation level) to be provided at a correction pixel (e.g., a gradation to be provided at the correction pixel A, as shown in the left column of FIGS. 4(*a*), 4(*b*), 5(*a*) and 5(*b*)), and a gradation signal applied to the correction pixel so as to permit a desired gradation display at the correction pixel (e.g., the gradation signal as shown in right column of FIGS. 4(*a*), 4(*b*), 5(*a*) and 5(*b*)), is prepared in advance as table data and a gradation signal to be applied to the correction pixel is obtained on the basis of the relationship between the state of the adjacent pixels and the gradation to be provided at the correction pixel. It is also possible to use a method wherein a gradation signal to be applied to the correction pixel is obtained by substituting states of adjacent pixels and a gradation to be provided at the correction pixel into a formation for calculation obtained in advance through experiment.

In the former method, the table data may preferably be obtained in advance through experiment and stored in a nonvolatile storing device (nonvolatile memory) (e.g., as indicated by a symbol M1 in FIG. 1(*a*); hereinafter referred to as a "first memory"), and the correction circuit R may preferably obtain a gradation signal to be applied to the correction pixel on the basis of data stored in the first memory M1.

(3) Hereinafter, the above described table data will be described in detail with reference to FIGS. 2 to 5.

Here, a relationship between a gradation signal and a display gradation (reflectance) in the case of driving only the pixel A (correction pixel) is shown in FIG. 2.

This relationship is not changed even when the adjacent pixels B, C, D and E are driven at the same gradation as the correction pixel A (FIG. 3). However, in the case where there is a large difference between a gradation to be provided at the adjacent pixels and a gradation to be displayed at the correction pixel, the resultant gradation displayed at the correction pixel is deviated under the influence of the adjacent pixels.

For example, in the case where a gradation (level) 4 is provided at the correction pixel A, all the combinations of display gradations at the adjacent pixels B, C, D and E are shown in the left column in FIG. 4(*a*), and a gradation (exactly a reflectance as a parameter corresponding to a gradation of a reflection type display device) when a gradation signal V4 which has not been corrected is applied to the correction pixel A, is shown in the central column in FIG. 4(*a*). As shown in FIG. 4(*a*), in the combinations of display gradations indicated by a symbol K11, the desired gradation 4 (reflectance=17%) is displayed at the correction pixel A by applying the gradation signal V4. However, in the combinations indicated by a symbol K12, the resultant gradation (brightness) is somewhat low (dark) compared with the case of the combinations of K11. Further, in the case where a gradation (level) 8 is provided at the correction pixel A, all the combinations of display gradations at the adjacent pixels B, C, D and E are shown in the left column in FIG. 4(*b*), and a gradation when a gradation signal V8 which has not been corrected is applied to the correction pixel A, is shown in the central column in FIG. 4(*b*). As shown in FIG. 4(*b*), in the combinations of display gradations indicated by a symbol K22, the desired gradation 8 (reflectance=33%) is displayed at the correction pixel A by applying the gradation signal V8. However, in the combinations indicated by a symbol K21, the resultant gradation (brightness) is somewhat high (bright) compared with the case of the combinations of K22. Further, in the combinations indicated by a symbol K23, the resultant gradation is somewhat dark.

Further, in the case where a gradation (level) 12 is provided at the correction pixel A, all the combinations of display gradations at the adjacent pixels B, C, D and E are shown in the left column in FIG. 5(*a*), and a gradation when a gradation signal V12 which has not been corrected is applied to the correction pixel A, is shown in the central column in FIG. 5(*a*). As shown in FIG. 5(*a*), in the combinations of display gradations indicated by a symbol K32, the desired gradation 4 (reflectance=49%) is displayed at the correction pixel A by applying the gradation signal V12. However, in the combinations indicated by a symbol K31, the resultant gradation (brightness) is somewhat high (bright) compared with the case of the combinations of K32. Further, in the case where a gradation (level) 16 is provided at the correction pixel A, all the combinations of display gradations at the adjacent pixels B, C, D and E are shown in the left column in FIG. 5(*b*), and a gradation when a gradation signal V16 which has not been corrected is applied to the correction pixel A, is shown in the central column in FIG. 5(*b*). As shown in FIG. 5(*b*), in the combinations of display gradations indicated by a symbol K42, the desired gradation 16 (reflectance=about 65%) is displayed at the correction pixel A by applying the gradation signal V16. However, in the combinations indicated by a symbol K41, the resultant gradation (brightness) is somewhat high (bright) compared with the case of the combinations of K42.

In this embodiment, the phenomena as described with reference to FIGS. 4(*a*), 4(*b*), 5(*a*) and 5(*b*) and correction values (V4' in FIG. 4(*b*), V8 and V8" in FIG. 4(*b*), V12' in FIG. 5(*a*), and V16' in FIG. 5(*b*)) for displaying a desired (predetermined) gradation (level) are experimentally obtained in advance with respect to all the gradations and are tabulated. The correction circuit R described above corrects the gradation signal by making reference to the resultant table.

(4) Next, a specific procedure of the correction of gradation signal will be described with reference to FIGS. 6 and 7.

First, flags i and j are set to 1 (S1 in FIG. 6) and gradations (e.g., pixel data) to be provided at a correction pixel Xi,j and its adjacent pixels Xi+1,j; Xi,j−1; xi−1,j; and Xi,j+1 are extracted (S2 in FIG. 6). In this case, the relationships: i−1≧1 and j−1≧1 must be satisfied. In this regard, pixels Xi,j−1 and Xi−1,j are actually not present in the case of i=j=1, and accordingly a necessary processing is effected.

Figure 6:
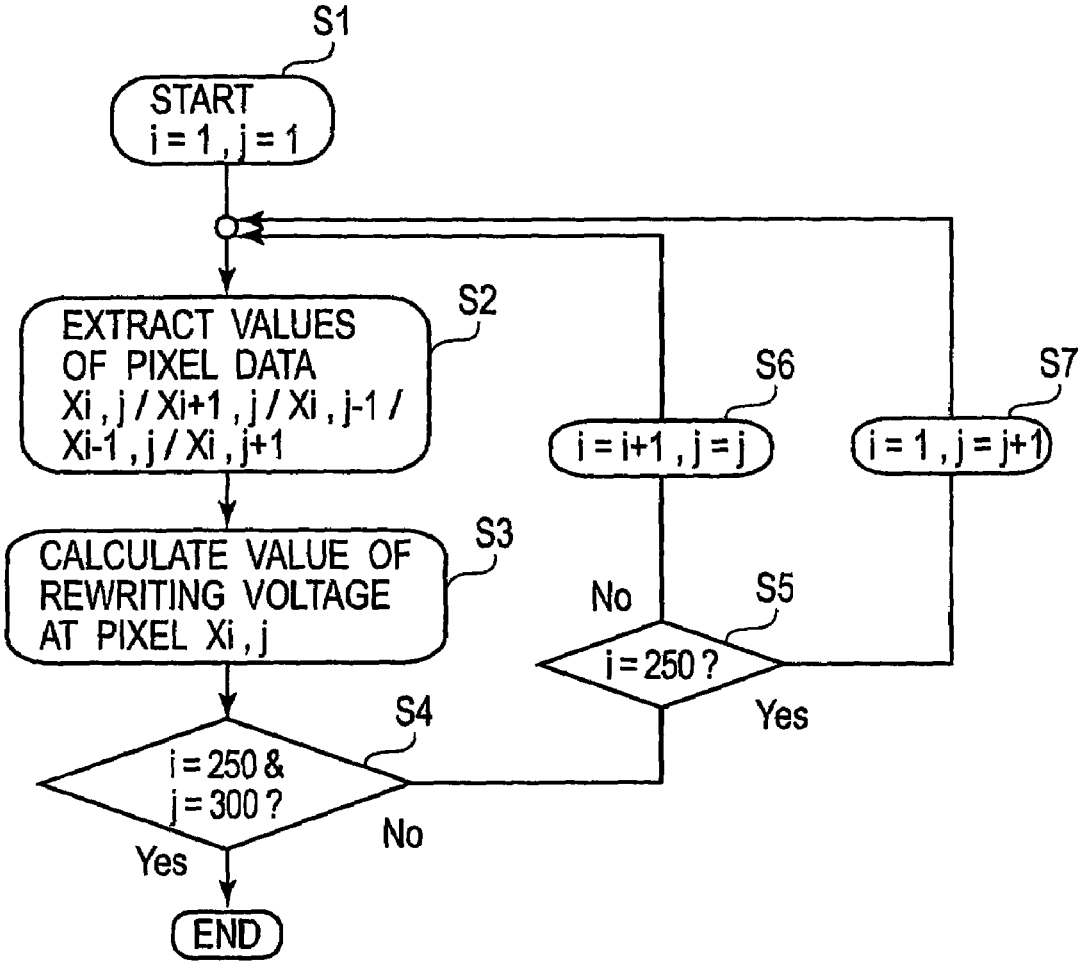
FIGS. 6 and 7 are respectively a flow chart for explaining a progress of data processing by a correction circuit.

Then, by making reference to the table data or the like, a gradation signal (e.g., a valve of rewriting voltage) to be applied to the correction pixel Xi,j is calculated (S3 in FIG. 6). The calculated result may preferably be stored in a second storing device (memory) M2 shown in FIG. 1(*a*). Then, i is changed from 1 to 2 while retaining j (=1) as it is (S4, S5 and S6 i FIG. 6), and a gradation signal for a correction pixel X2, 1 is calculated (S2 and S3 in FIG. 6). After the gradation signals for the pixels arranged in rows are calculated, a gradation signal for a second row pixel is calculated by setting i=1 and j=2 (S4, S5 and S7 in FIG. 6). At the time of calculated a gradation signal for the last row pixel, calculation of gradation signals is completed (S4 in FIG. 6).

At that time, the gradation signals for all the pixels are stored in the second memory M2 etc., and the signals are sent to the display device to display an image.

Figure 7:
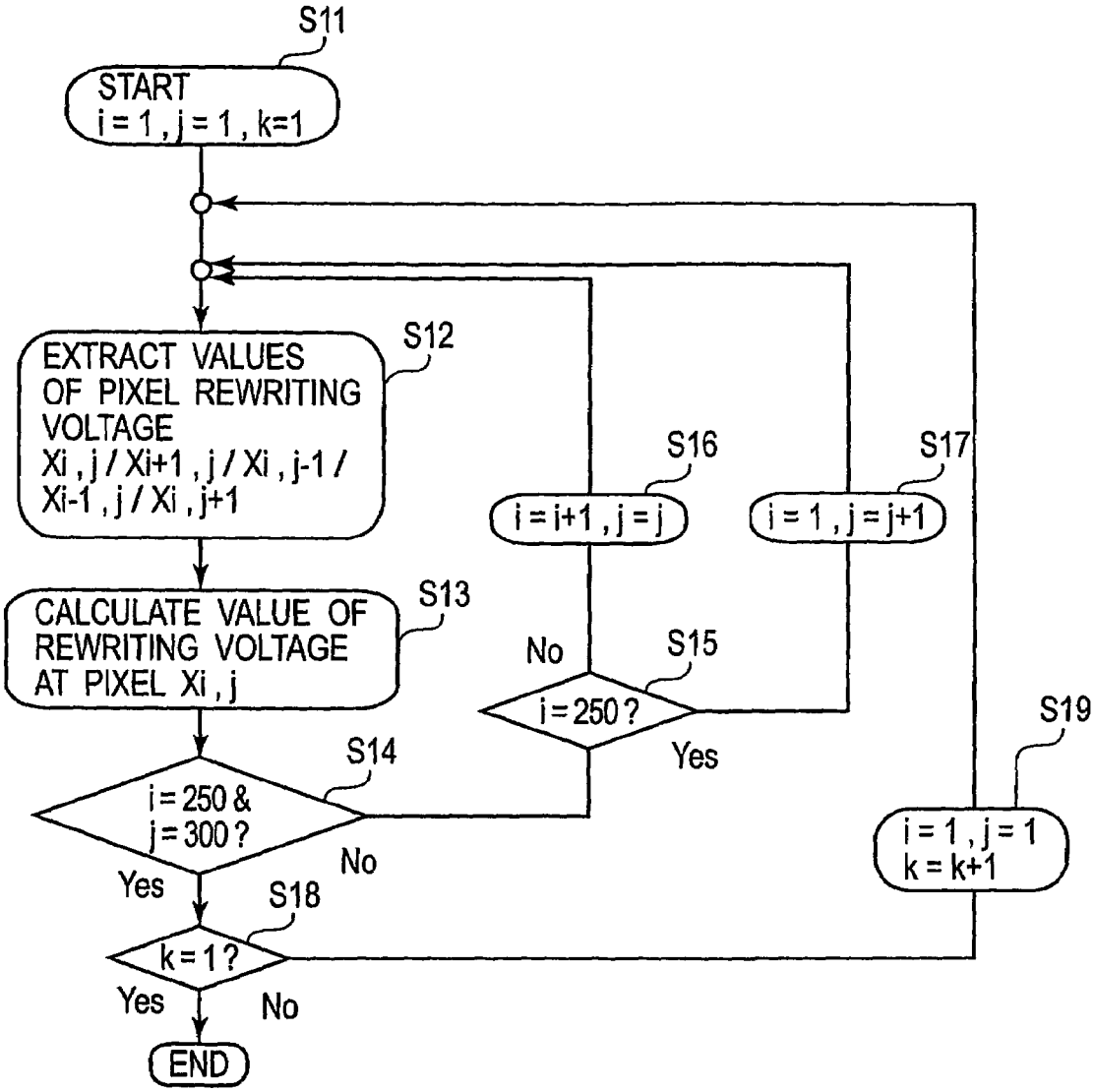

After the data processing shown in FIG. 6, data processing shown in FIG. 7 may be effected. More specifically, as shown in FIG. 7, after the gradation signals (rewriting voltages) for all the pixels are calculated as described above, the calculation results (calculated gradation signals) for the correction pixel Xi,j and the adjacent pixels Xi+1,j; Xi,j−1; Xi−1,j; and Xi,j+1 are extracted (S12), and a gradation signal (e.g., a value of rewriting voltage) to be applied to the correction pixel Xi,j is calculated by making reference to table data etc. (S13). This processing is effected similarly with respect to all the pixels (S14, S15, S16 and S17).

Such a calculation for all the pixels may be effected not only once but also plural times (S18 and S19). An accuracy of correction is improved as the number of such a calculation is increased.

In this case, the table data to which reference is to be made are not those shown in FIGS. 4 and 5 (i.e., with respect to the relationship between the display gradations and the correction gradation signals) but those with respect to a relationship between gradation signals (e.g., rewriting voltages) calculated through data processing, shown in FIG. 6, for the pixels Xi,j; Xi+1,j; Xi,j−1; Xi−1,j; and Xi,j+1, and a correction gradation signal for the correction pixel Xi,j.

The correction of the gradation signal by the correction circuit R may preferably be made in the case where a deviation of the display gradation is out of a predetermined range. For example, in the case where a deviation ratio (={(a gradation provided by a gradation signal which has not been corrected)/(a gradation to be provided)}×100) is within a predetermined acceptable range (e.g., less than ±3% in terms of an absolute value), the data processing shown in FIG. 6 may be omitted. The gradation provided by the correction shown in FIGS. 6 and 7 may not be necessarily completely identical to that to be provided originally but may have an error which is within the predetermined acceptable range. In other words, a variation in reflectance is not necessarily required to become zero by making the correction. For example, it is sufficient to make the correction so as to provide a reflectance variation of less than ±1% (in terms of an absolute value). Accordingly, a rewriting voltage conversion table is prepared by calculating a correction value with respect to a gradation signal providing a reflectance variation of not less than ±1% (in terms of an absolute value). Such an experiment may generally preferable be performed by an automatic measuring system. Further, the correction of rewriting voltage may preferably be made on the basis of magnitude (amplitude) of applied voltage, a length of voltage application time, voltage application timing., etc.

(5) Next, the display device will be described.

As the display device P, a display device which includes a plurality of pixels arranged in a matrix and is capable of effecting gradation display at each pixel, can be used. For example, the display device P may include the electrophoretic display device (e.g., P1 shown in FIG. 8(*a*)) for displaying various information by moving electrophoretic particles 3, and the liquid crystal display device (e.g., P2 shown in FIG. 11(*a*)) for displaying various information by applying a voltage to a liquid crystal 13.

Hereinafter, the respective structures of the electrophoretic display device and the liquid crystal display device will be described more specifically.

(5-1) Structure of electrophoretic display device

Figure 8:
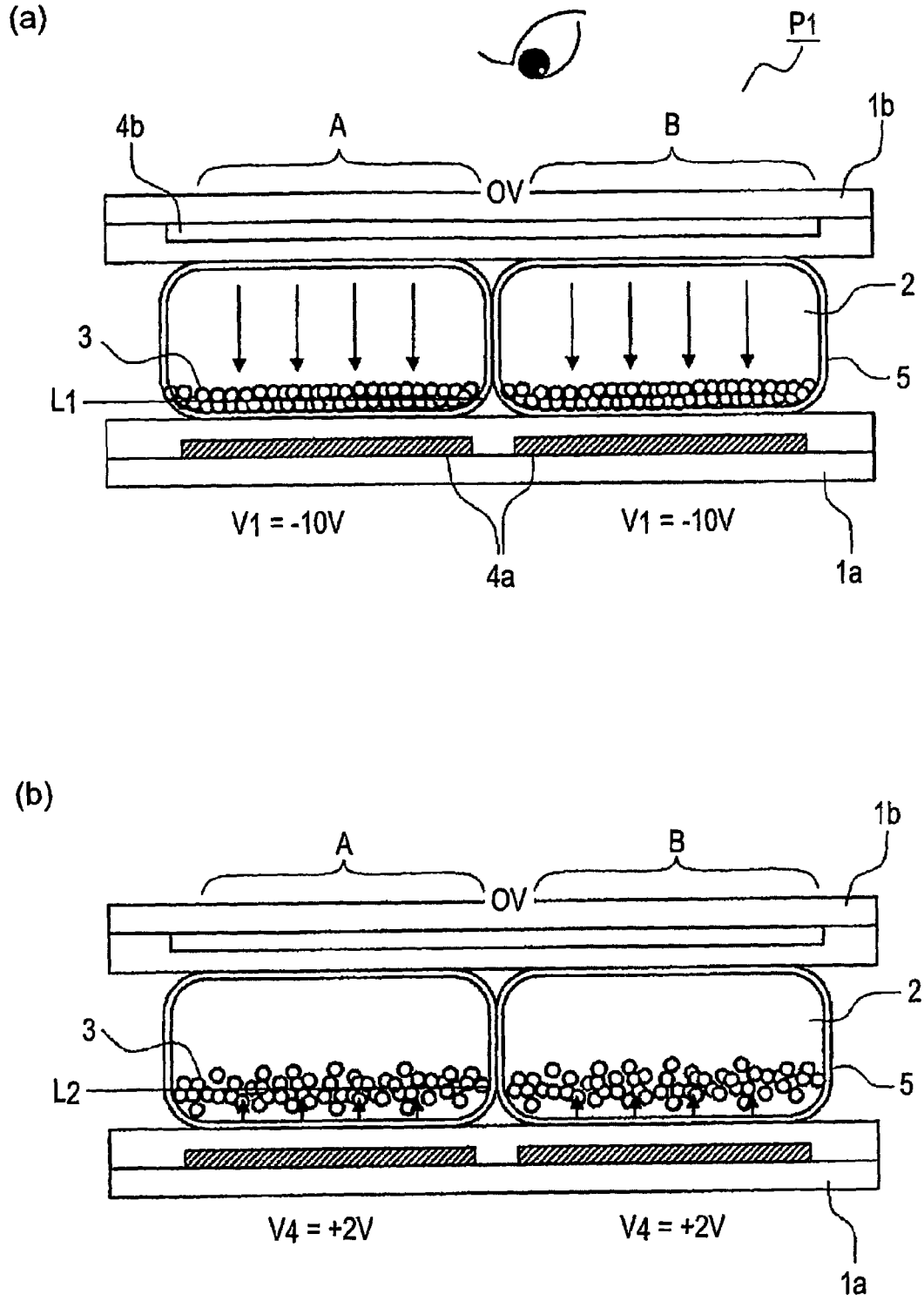
FIGS. 8(*a*), 8(*b*), 9(*a*), 9(*b*), 10(*a*) and 10(*b*) are respectively a sectional view for explaining a drive state of an electrophoretic display device.

The electrophoretic display device P1 may include, as shown in FIGS. 8(*a*), 8(*b*), 9(*a*), 9(*b*), 10(*a*) and 10(*b*), a pair of substrates 1*a* and 1*b* disposed opposite to each other with a spacing, a plurality of electrophoretic particles (charged migration particles) 3 and a dispersion liquid 2 which are disposed in the spacing, and a pair of electrodes 4*a* and 4*b* which are disposed close to the dispersion liquid 2. The electrophoretic display device may preferably be driven according to an active matrix driving scheme by connecting a switching device, such as a thin film transistor (TFT) onto one of the electrodes (e.g., the electrode 4*a*). The electrophoretic display device may further be connected with a power source, a timing controller, a D/A converter, a shift register, etc. The electrophoretic display device may also be driven according to a generally known passive matrix driving scheme.

The electrophoretic display device P1 described above may preferably be of a reflection-type. A structure and a driving method for the reflection type electrophoretic display device will be described below.

In the reflection-type electrophoretic display device, the electrodes 4*a* and 4*b* are disposed to sandwich the dispersion liquid 2 therebetween, and the dispersion liquid 2 and the electrophoretic particles 3 may preferably be colored different colors. In the following description, for convenience of explanation, the dispersion liquid 2 is colored black and the electrophoretic particles are colored white.

Such a reflection type electrophoretic display device P1 may be driven by the voltage modulation method as follows.

(a) As shown in FIGS. 8(*a*) and 2, when the electrode 4*a* is supplied with a voltage V1=−10 V while keeping the electrode 4*b* at 0 V, the electrophoretic particles 3 are stopped at a position L1 along the electrode 4*a* to provide a gradation (level) 1.

(b) As shown in FIGS. 8(*b*) and 2, when the electrode 4*a* is supplied with a voltage V4=+2 V, the electrophoretic particles 3 are stopped at a position L2 to provide a gradation 4.

Figure 9:
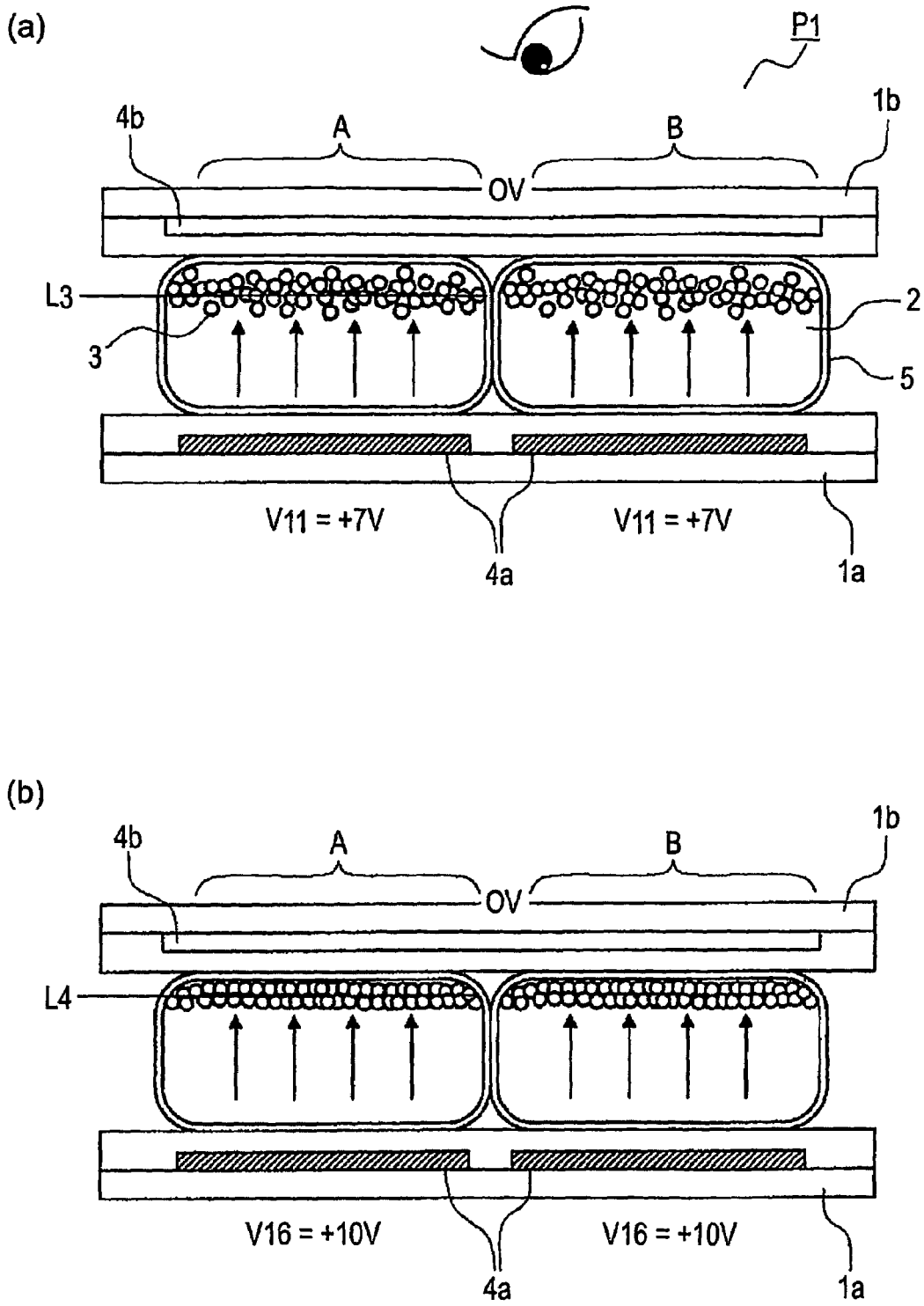

(c) As shown in FIGS. 9(*a*) and 2, wherein the electrode 4*a* is supplied with a voltage V11=+7 V, the electrophoretic particles are stopped at a position L3 to provide a gradation 11.

(d) As shown in FIGS. 9(*b*) and 2, when the electrode 4*a* is supplied with a voltage V16=+10 V, the electrophoretic particles are stopped at a position L4 to provide a gradation 16.

Similar gradation display may be performed by also the pulse width modulation method.

Figure 10:
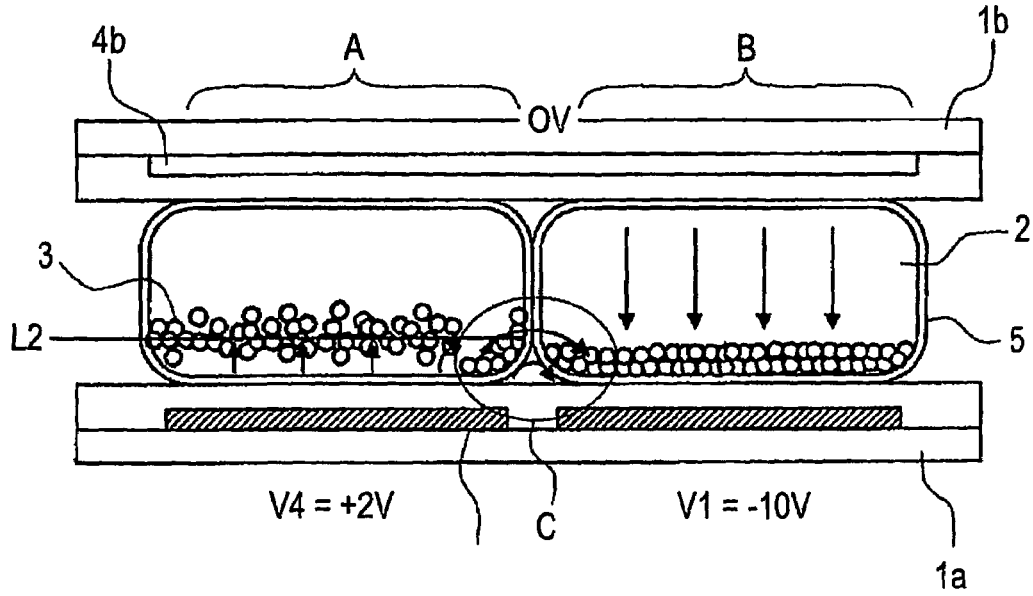
Figure 10:
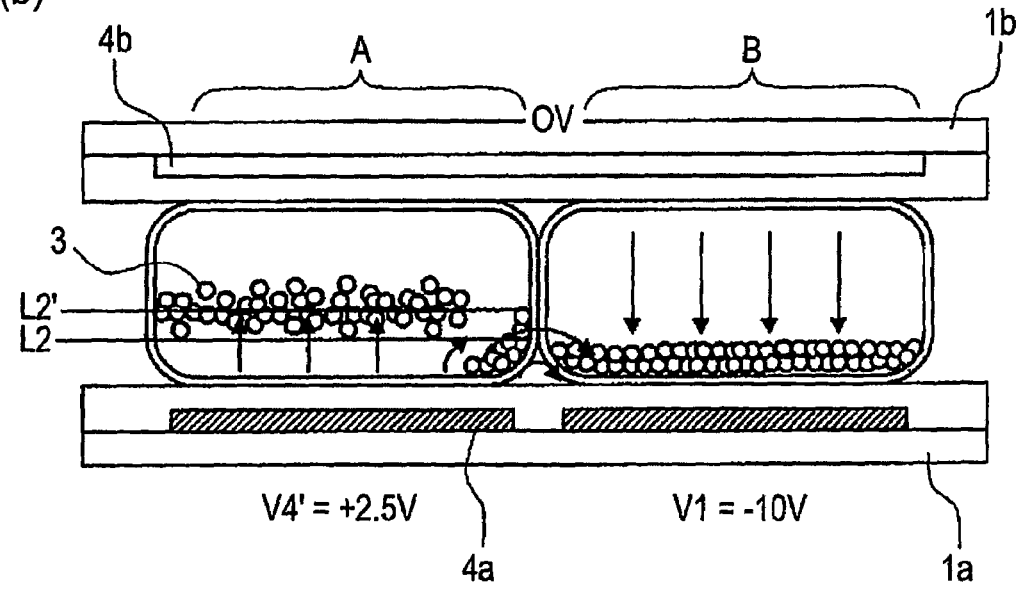

In FIGS. 8(*a*), 8(*b*), 9(*a*) and 9(*b*), the same voltage is applied to the electrode 4*a* at adjacent pixels A and B, so that a desired gradation can be provided without correcting the gradation signal. However, as shown in FIGS. 10(*a*), when the applied voltages to the adjacent pixels A and B are different from each other, an electric field interference between the adjacent pixels is caused to occur. As a result, the electrophoretic particles in the vicinity of a pixel boundary are disordered (e.g., an electric field at a portion C is affected by a voltage applied to the pixel B disposed adjacent to the pixel A) to cause deviation of display gradation. More specifically, when all the electrophoretic particles in the vicinity of the pixel boundary are stopped at the position L2 as shown in FIG. 8(*b*), the gradation 4 can be provided. However, a part of the electrophoretic particles 3 is moved toward the substrate 1*a* side, so that the resultant display gradation becomes somewhat darker. More specifically, a resultant reflectance at the gradation 4 should be originally 17% but an actual reflectance was about 15%>

Accordingly, as shown in FIG. 10(*b*), the gradation signal is corrected from V4 (=+2.0 V) to V4' (=+2.5 V) to change the position of electrophoretic particles 3 from L2 to L2', thus realizing the gradation 4 (reflectance=17%).

In the electrophoretic display device P1, a partition wall is provided between the adjacent pixels so as to suppress movement of the electrophoretic particles 3 at a pixel to another pixel adjacent to the pixel. Further, the dispersion liquid 2 and the electrophoretic particles 3 may preferably be sealed in a microcapsule 5. This microcapsule 5 may be provided in a position corresponding to each pixel. The position of the microcapsule, however, may not be aligned with the pixel. Further, it is also possible to dispose a plurality of microcapsules at one pixel.

Figure 11:
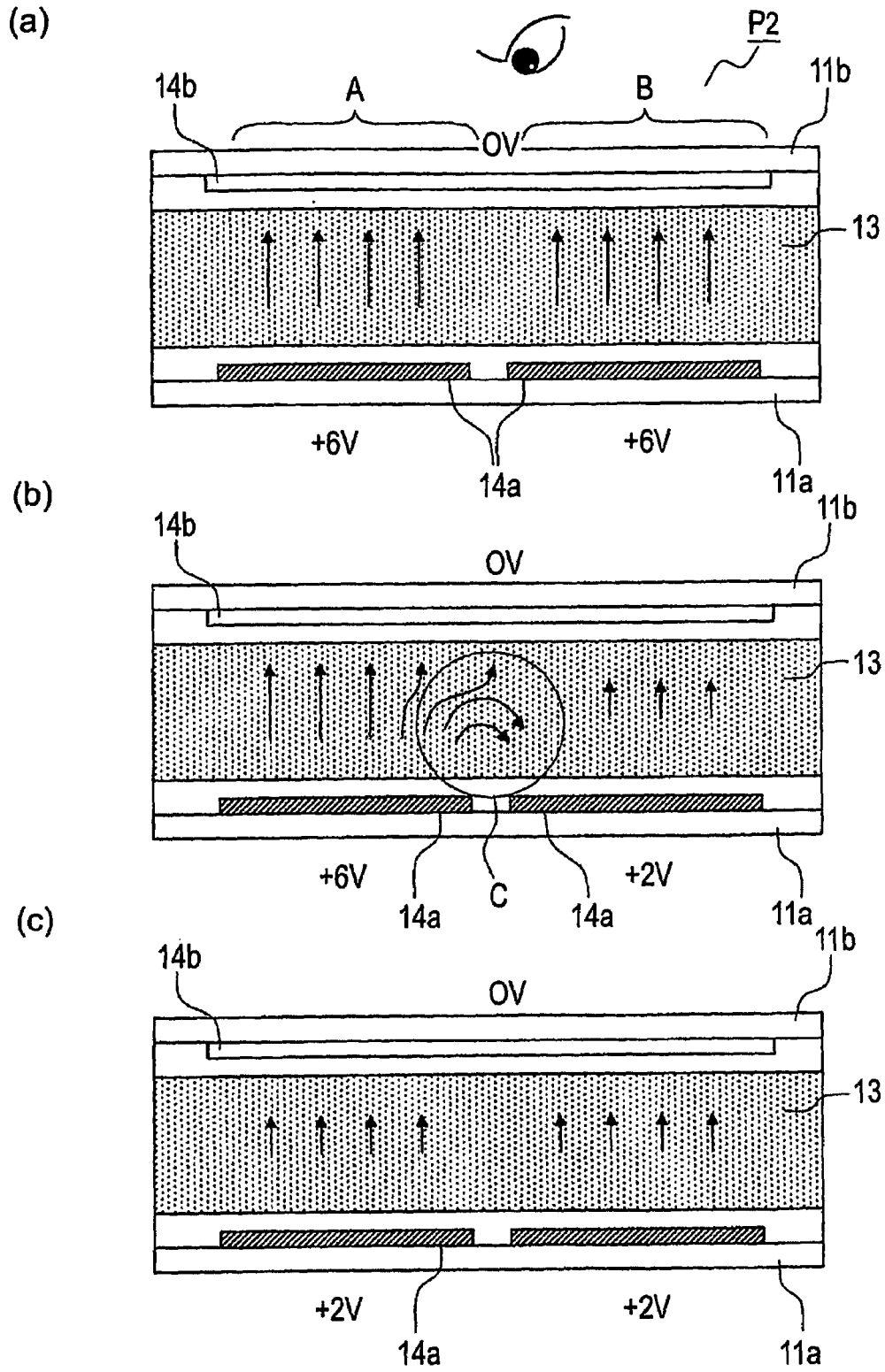
FIGS. 11(*a*), 11(*b*) and 11(*c*) are respectively a sectional view for explaining a drive state of a liquid crystal display device.
Figure 12:
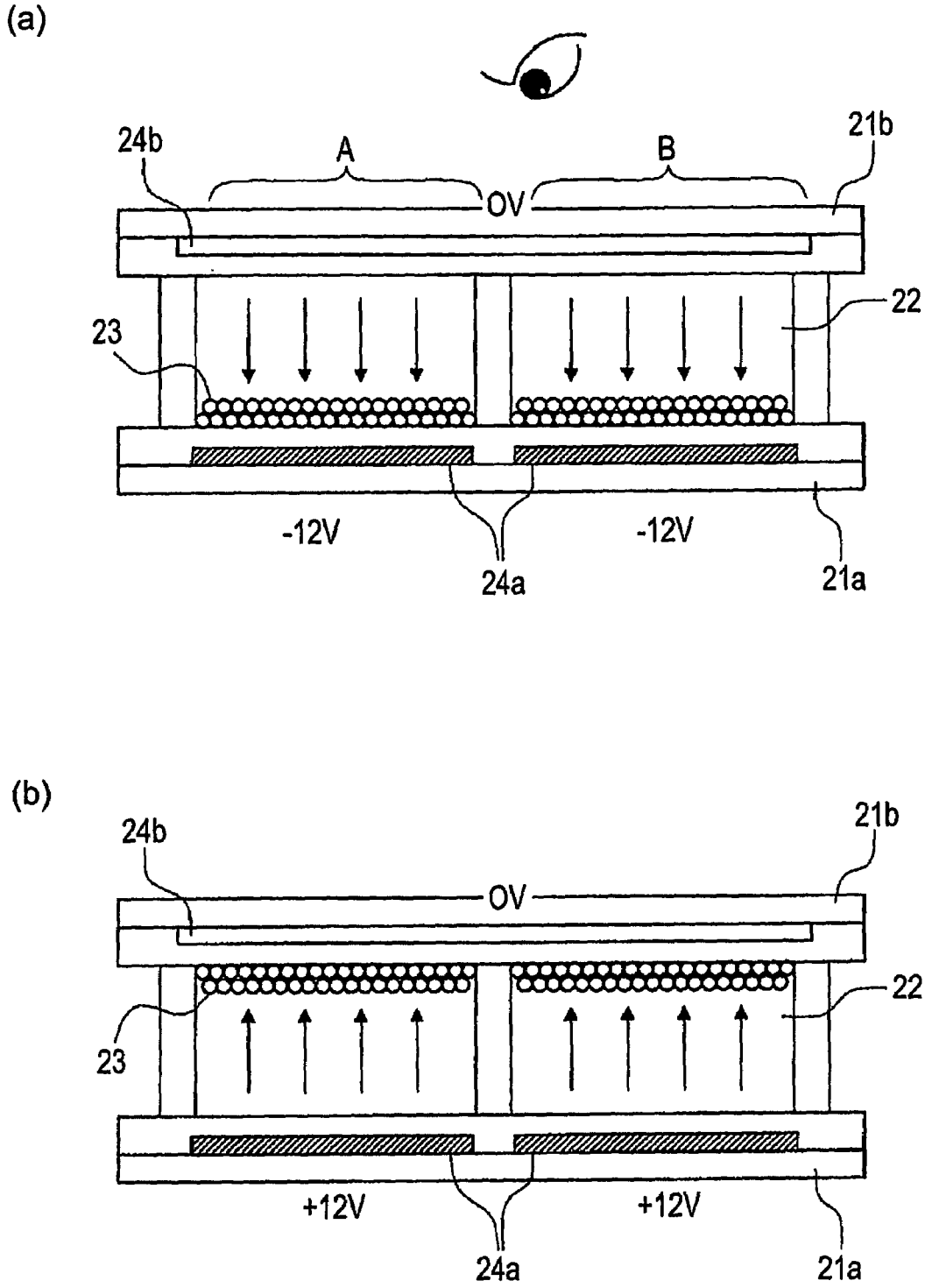
FIGS. 12(*a*) and 12(*b*) are respectively a sectional view showing an embodiment of a structure of a conventional electrophoretic display device.
Figure 13:
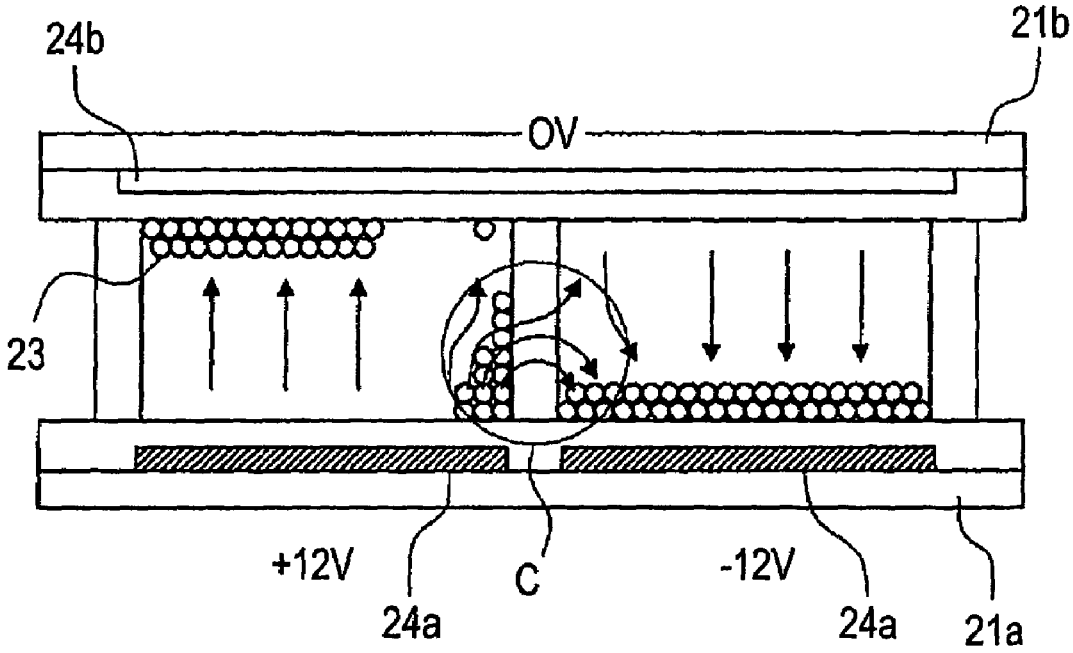
FIG. 13 is a sectional view for illustrating a conventional problem.

(5-2) Structure of liquid crystal display device As shown in FIGS. 11(*a*), 11(*b*) and 11(*c*), the liquid crystal display device may include a pair of substrates 11*a* and 11*b* disposed opposite to each other with a spacing, a liquid crystal layer 13 disposed in the spacing, and a pair of electrodes 14*a* and 14*b* disposed so as to sandwich the liquid crystal layer 13. Of the electrodes 14*a* and 14*b*, one electrode 14*b* may be a common electrode connected in common with all the pixels and the other electrode 14*a* may be a pixel electrode for each pixel. The common electrode is grounded (to have a voltage of 0 V) and a rewriting voltage applied to the pixel electrode is changed, whereby it is possible to effect switching of display mode.

In the case where the liquid crystal display device is of a reflection type, the rear electrode 14*a* may preferably be formed of a metal having a high reflectance so as to function as a reflection layer.

As shown in FIGS. 11(*a*) and 11(*c*), when the same voltage is applied to both the adjacent pixels A and B, it is possible to provide an appropriate gradation. However, as shown in FIG. 11(*b*), when voltages applied to the adjacent pixels A and B are different from each other, an alignment state of liquid crystal is disordered at a pixel boundary portion C, thus causing deviation of display gradation. For this reason, the applied voltage to the pixel A is corrected to obviate the deviation of display gradation.

(6) Capacities of the memories M1 and M2 are not particularly restricted, and as the memories M1 and M2, it is possible to use a line memory, a frame memory, etc.

According to the embodiment described above, it is possible to provide a desired gradation (level) by compensating an influence on the correction pixel from its adjacent pixels.

EXAMPLES

Hereinbelow, the present invention will be described more specifically based on Examples.

Example 1

A display apparatus shown in FIGS. 1(*a*) and 1(*b*) was prepared in the following manner. The display apparatus included, as a display device P, an electrophoretic display device P1, as shown in FIGS. 8(*a*) and 8(*b*) having a matrix of pixels with 300 rows and 250 columns.

The electrophoretic display device P1 included a pair of 1.1 mm-thick glass substrates 1*a* and 1*b*. In a spacing between these substrates 1*a* and 1*b*, a plurality of microcapsules 5 each containing a dispersion liquid 2 and electrophoretic particles 3 were prepared through a composite coacervation method and disposed. The dispersion liquid 2 was colored black with a dye, and the electrophoretic particles 3 were formed of white titanium oxide. A electrode 4*b* on an observer (viewer) side ("common electrode") was formed of transparent ITO (indium tin oxide), and an opposite electrode 4*a* ("pixel electrode") was formed of Al (aluminum). Further, to each of the pixel electrodes 4*a*, a TFT (not shown) was connected so as to permit frame rewriting by an active matrix driving scheme.

From a drive circuit Q, digital image data were outputted. In a correction circuit R, the digital image data were corrected depending on a characteristic of the display device. In an analog signal generating circuit U, a digital signal was converted into an analog signal.

In the correction circuit R, data processing as shown in FIG. 6 was performed. The display apparatus in this example effects 4 bit-gradation display at each pixel. The image data comprises digital information providing 4 bit-gradation at each pixel. When the inputted image data are not 4 bit-gradation data, they are converted into 4 bit-gradation data.

First, referring again to FIG. 6, i=1 and j=1 are set (S1), and values of image data for a correction pixel Xi,j and its adjacent pixels Xi+1,j; Xi,j−1; Xi−1,j; and Xi,j+1 are extracted from a memory (S2). Then, by making reference to table data (rewriting voltage conversion table data), a rewriting voltage for the correction pixel Xi,j is calculated (S3). The thus calculated rewriting voltage (digital information providing a voltage value) is stored in the second memory M2.

Thereafter, checking of "i=250 and j=300" is arrived out (S4), and in the case of "No", checking of "i=250" is carried out (S5). However, as described above, i=j=1, so that i=i+1 is set (S6). The extraction (S2) and the calculation of rewriting voltage (S3) are performed in the same manner as described above.

Similar processing is repeated, and at such a stage that image data for 250 pixels X1,1; X2,1; X3,1; . . . X250,1 are sequentially extracted completely, i is 250 and j is 1, so that i is set to 1 and J is set to 2 (S4, S5 and S7). Thereafter, image data for 250 pixels X1,2; X2,21 X3,2; . . . X250,2 are extracted. Similarly, image data are extracted after the value of j is changed to 3, 4, 5, . . . 300.

When a rewriting voltage value for the last pixel x250,300 is determined, i is 250 and j is 300, so that the data processing is completed (S4).

Next, the rewriting voltage conversion table used in this example will be described.

The rewriting voltage conversion table was prepared through an experiment with an automatic measuring system while paying attention to the correction pixel Xi,j and its adjacent pixels Xi+1,j; Xi,j−1; Xi−1,j; and Xi,j+1 in the display apparatus having the matrix with 300 rows and 250 columns.

First, a reference at the correction pixel Xi,j when the same rewriting voltage was applied to the correction pixel Xi,j and the adjacent pixels Xi+1,j; Xi,j−1; Xi−1,j; and Xi,j+1, and a reflectance at the correction pixel Xi,j when a first rewriting voltage was applied to the correction pixel Xi,j and a second rewriting voltage which was different from the first rewriting voltage, was applied to the adjacent pixels Xi+1,j; Xi,j−1; Xi−1,j; and Xi−1,j, were obtained.

Next, in the case where a difference between these reflectances (i.e., a variation in reflectance) was not less than ±2% (in terms of an absolute value), the rewriting voltage for the correction pixel Xi,j was corrected so that the later reflectance was less than ±2% (in terms of an absolute value) on the basis of the former reflectance. The correction of rewriting voltage was performed by changing the magnitude of applied voltage and/or the length of voltage application time and/or the voltage application timing. In the above described manner, with respect to all the combinations of rewriting voltages providing a reflectance variation of not less than ±2% (as an absolute value), correction values were obtained to prepare a rewriting voltage conversion table.

After the correction of digital image data by the correction circuit R, an analog signal for driving the display device was generated in the analog signal generating circuit U and the rewriting voltage was applied to the display device having the matrix with 300 rows and 250 columns.

As a result, it was possible to effect 16 gradation (level) display at each pixel with a variation within ±2% on the basis of a desired reference for each gradation (level).

Example 2

In this example, rewriting voltages for all the pixels were determined in the same manner as in Example 1 by using the same apparatus as in Example 1, and were stored in a memory.

The data processing shown in the flow chart of FIG. 7 was performed.

More specifically, i=1, j=1 and k=1 are set (S11), and values of the rewriting voltages for a correction pixel Xi,j and its adjacent pixels Xi+1,j; Xi,j−1; Xi−1,j; and Xi,j+1 were extracted from the memory (S12).

Next, a rewriting voltage for the correction pixel Xi,j is obtained by making reference to table data (S13). The obtained rewriting voltage value is digital information providing a voltage value, which is stored in a predetermined memory.

Then, when "i=250 an j=300" are not satisfied, checking of "i=250" is carried out (S14 and S15). In the case where "i=250" is not satisfied, i=i+1 and j=j are set (S15 and S17), and a correction value of rewriting voltage is obtained (S12 and S13). This data processing is repeated until "i=250 and j=300" are satisfied, whereby new (correction) values of rewriting voltage for all the pixels (300×250 matrix) are determined (S14).

Next, checking of "k=3" is carried out and when "k=3" is not satisfied, i=1, j=1 and k=k+1 are set. Thereafter, the above described sequence of data processing is repeated.

After all, with respect to all the pixels, the correction of rewriting voltage is made three times (k=1, 2 and 3) to complete the data processing.

Next, the rewriting voltage conversion table used in this example will be described.

The rewriting voltage conversion table was prepared through an experiment with an automatic measuring system while paying attention to the correction pixel Xi,j and its adjacent pixels Xi+1,j; Xi,j−1; Xi−1,j; and Xi,j+1 in the display apparatus having the matrix with 300 rows and 250 columns.

First, a reference at the correction pixel Xi,j when the same rewriting voltage was applied to the correction pixel Xi,j and the adjacent pixels Xi+1,j; Xi,j−1; Xi−1,j; and Xi,j+1, and a reflectance at the correction pixel Xi,j when a first rewriting voltage was applied to the correction pixel Xi,j and a second rewriting voltage which was different from the first rewriting voltage, was applied to the adjacent pixels Xi+1,j; Xi,j−1; Xi−1,j; and Xi−1,j, were obtained.

Next, in the case where a difference between these reflectances (i.e., a variation in reflectance) was not less than ±1% (in terms of an absolute value), the rewriting voltage for the correction pixel Xi,j was corrected so that the later reflectance was less than ±1% (in terms of an absolute value) on the basis of the former reflectance. The correction of rewriting voltage was performed by changing the magnitude of applied voltage and/or the length of voltage application time and/or the voltage application timing. In the above described manner, with respect to all the combinations of rewriting voltages providing a reflectance variation of not less than ±1% (as an absolute value), correction values were obtained to prepare a rewriting voltage conversion table.

After the correction of digital image data by the correction circuit R, an analog signal for driving the display device was generated in the analog signal generating circuit U and the rewriting voltage was applied to the display device having the matrix with 300 rows and 250 columns.

As a result, it was possible to effect 16 gradation (level) display at each pixel with a variation within ±2% on the basis of a desired reference for each gradation (level).

Example 3

In this example, a display apparatus shown in FIG. 1 including a liquid crystal display device P2 shown in FIG. 11 was prepared.

As a pair of substrates 11*a* and 11*b*, a 1.1 mm-thick glass substrate was used. An electrode 14*b* on an observer side was formed of transparent ITO and an opposite electrode 14*a* was formed of Al. Other structural members and data processing were the same as those in Example 1.

As a result, according to this example, it was possible to effect display at an appropriate gradation.

INDUSTRIAL APPLICABILITY

As described hereinabove, according to the present invention, it is possible to provide a desired gradation by compensating an influence on a pixel from its adjacent pixels in a display apparatus using an electrophoretic display device or a liquid crystal display device.

The invention claimed is:

1. A display apparatus, comprising:

an electrophoretic display device having a plurality of pixels arranged in a matrix, each pixel including charged particles in a dispersion liquid and a pair of electrodes disposed close to the dispersion liquid, and a position of the charged particles in the pixel providing a gradation, and a drive circuit for outputting a gradation signal to each pixel, wherein the gradation of each pixel is influenced by gradation signals of adjacent pixels through an electric field interference between pixels, and further comprising a correction circuit for correcting the gradation signal at each pixel to compensate for the influence from the gradation signals of the adjacent pixels.

2. An apparatus according to claim 1, wherein the plurality of pixels include a correction pixel at which a gradation signal is corrected by the correction circuit and adjacent pixels surrounding the correction pixel, and the correction circuit obtains a gradation signal, to be corrected, on the basis of information on a gradation to be provided at the correction pixel and information on a gradation to be provided at the adjacent pixels.

3. An apparatus according to claim 2, wherein said apparatus further comprises a first storing device which stores a relationship between states of the adjacent pixels, a gradation to be provided at the correction pixel, and a gradation signal to be applied to the correction pixel so as to provide a desired gradation at the correction pixel, the correction circuit obtaining the gradation signal to be applied to the correction pixel on the basis of data stored in the first storing device.

4. An apparatus according to claim 1, wherein the correction of the gradation signal by the correction circuit is effected when a deviation ratio of a display gradation is out of a predetermined range.

* * * * *